US005390719A

United States Patent [19]

Barnes

[11] Patent Number: 5,390,719

[45] Date of Patent: Feb. 21, 1995

[54] CANOPY ASSEMBLY PIVOTABLE BY OVER-HEIGHT VEHICLE

[76] Inventor: Michael S. Barnes, 4300 Acworth Industrial Dr., Acworth, Ga. 30101

[21] Appl. No.: 103,691

[22] Filed: Aug. 10, 1993

[51] Int. Cl.[6] ..... G08B 13/08

[52] U.S. Cl. ..... 160/10; 160/46

[58] Field of Search ..... 160/10, 46, 49, 56, 160/57, 58.1, 59, 81, 76, 77; 135/89, 90; 49/26, 27, 31, 32, 141, 364; 340/436

[56] References Cited

U.S. PATENT DOCUMENTS 1,007,306 10/1911 Nevins et al. .
3,044,540 7/1962 Hammersley ..... 160/46 X
3,121,458 2/1964 Blanchard ..... 160/58.1
4,870,782 10/1989 Purves .
4,916,429 4/1990 Hicks et al. .
5,207,255 5/1993 Shannon ..... 160/46 X

*Primary Examiner*—David M. Purol
*Attorney, Agent, or Firm*—Oblon, Spivak, McClelland, Maier & Neustadt

[57] ABSTRACT

A canopy assembly for use at fast food restaurants or the like and beneath which vehicles normally drive. An over-height impact bar is carried by a frame of the canopy assembly and when struck, first energizes an alarm and then travels over a first lost motion distance enabling a driver to react to the alarm and stop the vehicle before it strikes the canopy. Should the driver not stop, the impact bar travels a second lost motion distance to cause a latch to be unlatched and permit the assembly to be swung by the oncoming vehicle clear of its path of movement.

6 Claims, 3 Drawing Sheets

16
49
51
50
52
5.
54
56
54'
58
62
60
14
80
82
72
78
7.
76
74
65
66
70
68
48
47
30
46
42
38
40
44
34
26
36
32
22
28
25
22'
27
20

CANOPY ASSEMBLY PIVOTABLE BY OVER-HEIGHT VEHICLE

FIELD OF THE INVENTION

This invention relates to canopies and more particularly to canopies, especially though not exclusively, for drive-through restaurants, and means for protecting such canopies from damage by over-height vehicles.

BACKGROUND OF THE INVENTION

It is known to place in front of roof overhangs or canopies of limited height and beneath which vehicles travel, as in fast food restaurants, pivotal arms designed to be struck by an over-height vehicle with the expectation that the sound of the impact of the vehicle with the arm will serve as a warning to the driver that he is about to strike the overhang or canopy. Should the sound of the impact not be heard or heeded, particularly where the over-height is caused by a relatively soft roof-top load, say, duffle bags, the sound might be muffled while such a load may still be massive enough to damage a canopy extensively, possibly bringing it down and severely damaging the vehicle.

This problem has been recognized in the patent to Hicks et al. U.S. Pat. No. 4,916,429 and the solution proposed there comprises an optical sensor located so as to detect over-height and energize an alarm intended to warn the driver that his vehicle is over-height and he must stop before the canopy is struck and damaged. The problem with this solution is that all too often a vehicle over-height is due to a roof top load which is carried so seldom, that a driver, seeing or hearing the alarms, may not realize that they are directed at him, and he thus may continue to drive resulting in almost certain damage to the canopy and possibly also to the load and the vehicle.

SUMMARY OF THE PRESENT INVENTION

The present invention is designed to prevent damage to a canopy by an over-height vehicle in two ways. The first is by movably mounting an impact bar on the side of a canopy which faces oncoming traffic. Switches, preferably micro switches, are associated with the bar such that the instant it is impacted by an over-height vehicle an alarm, which may be visual, audible, or both is energized to warn the driver to stop his vehicle instantly. Obviously, should the driver react to the alarm, there is bound to be a time lag as he reacts but the bar is provided with sufficient initial lost motion that an average driver will have time to stop his vehicle before the impact bar engages the canopy proper. Because an occasional driver will not be aware that the alarm signals are addressed to him, forgetting that he is uncustomarily carrying a high roof-top load, he may continue to drive thus moving the impact bar through an additional increment of lost motion until a point is reached at which latch means are released to permit the canopy to be swung by the oncoming vehicle from a latched position across the path of the vehicle to a position clear of the path. The latch could comprise a shear pin though preferably it is a pin spring-urged to an extended latching position but is retracted in response to second predetermined lost motion of the impact bar.

Thus the object of the invention is to provide two means for preventing damage which might be caused by impact of an over-height vehicle with a canopy, the first being an alarm triggered by impact of an over-height vehicle with an impact bar carried by the canopy, but if that is ineffective, then the second means comprises mechanism for automatically unlatching the canopy from its normal position of use to enable it to be swung by the vehicle clear of its path of movement.

Other objects and their attendant advantages will become apparent as the following detailed description is read in conjunction with the accompanying drawings:

DETAILED DESCRIPTION OF THE DRAWINGS

Figures 1, 2:
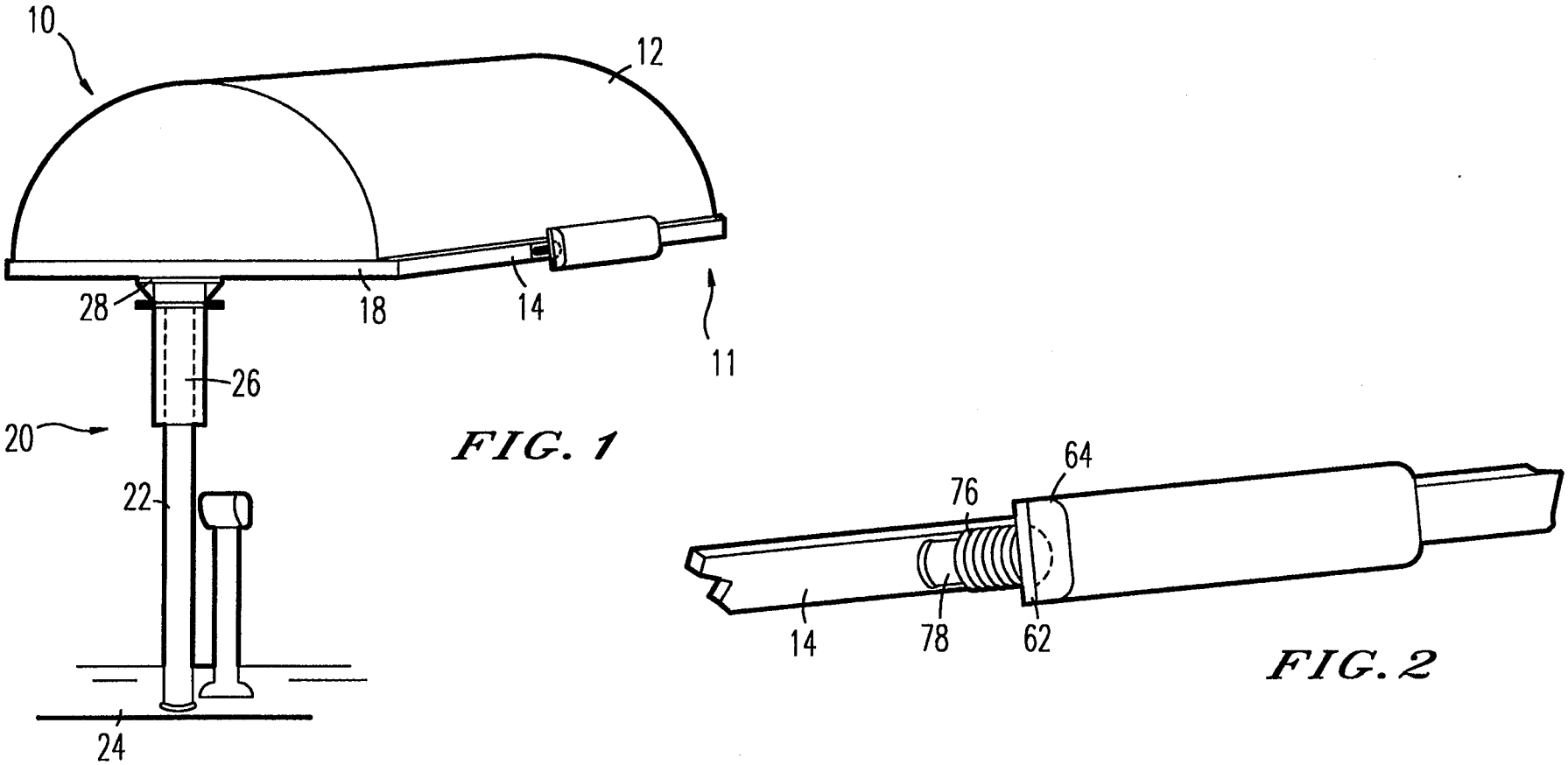
FIG. 1 is a perspective view of a canopy assembly incorporating the present invention.
FIG. 2 is an enlarged broken perspective view of an impact bar which may be employed with the canopy assembly of FIG. 1.

Referring now to the drawings, 10 designates broadly a canopy assembly comprising a rigid frame 11 carrying a canopy 12 which may be of any shape such as the semi-cylindrical shape shown. The frame 11 may be rectangular having front and rear side members 14, 16 (see FIG. 3) and opposed end members 18, only one of which is visible in FIG. 1. A mount 20, which may be a hollow rigid vertical pole 22 firmly fixed at its lower end to the ground 24 rotatably receives over its annular upper end 22' (see FIG. 4) the closed upper end 25 of a relatively short cylindrical sleeve 26 whose upper end is connected, as by the gussets 27 shown, to a plate 28 which in turn is rigidly fixed to one end of the frame 11. Thus the canopy assembly is rotatably supported by the mount 20 from one end of the frame 11 to extend horizontally in cantilever fashion above the ground 24 at a height, say nine feet, selected to be greater than that of a majority of vehicles likely to be driven beneath the canopy.

Figures 3, 4, 5:
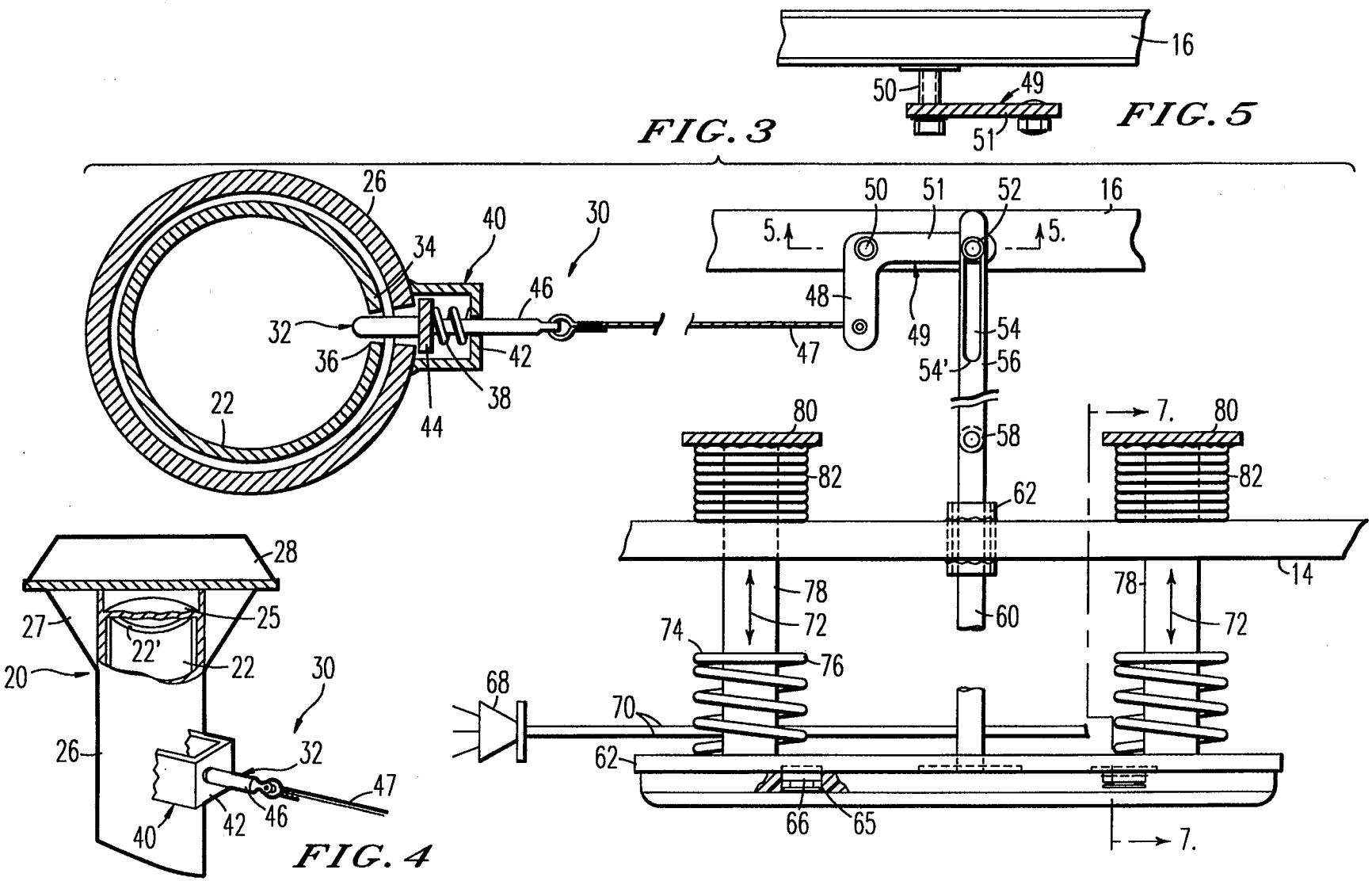
FIG. 3 is an enlarged broken view, partly in horizontal cross section, of alarm and canopy latch operating mechanism of the invention.
FIG. 4 is a broken perspective view of a rotatable mount for the canopy assembly illustrated in FIG. 1.
FIG. 5 is a broken vertical cross sectional view taken substantially on the line 5—5 of FIG. 3.

In accordance with the invention a releasable latch, broadly designated in FIGS. 3 and 4 by the numeral 30, retains the canopy assembly in a predetermined radial position on the mount 20 to extend over an area of ground 24 which is to be protected from weather, and across which vehicles travel in a direction from the front side member 14 towards the rear side member 16. A typical protected area would be a pick-up station of a fast food restaurant. The latch 30 is designed to be automatically released should the canopy assembly be struck by an over-height vehicle and, with reference to FIG. 3, the latch preferably comprises a pin 32 which extends through a first opening 34 in the sleeve 26 and a second opening 36 in the pole 22. It is within the purview of the invention for the pin 32 to be a simple frangible shear pin which breaks when sufficient force is exerted there against but desirably the pin is urged towards the extended latching position shown by a spring 38 in a bracket 40 fixed to the exterior of the canopy sleeve 26. The spring 38 is trapped between a bracket cover 42 and a collar 44 fixed to the pin 32 whose opposite end 46 extends through an opening in the cover 40 and is apertured to receive one end of a flexible connector 47 whose opposite end is connected to one arm 48 of a bell crank 49 pivotally carried on the lower end of a post 50 fixed to the underside of the rear frame member 16 as best seen in FIG. 5.

Figure 7:
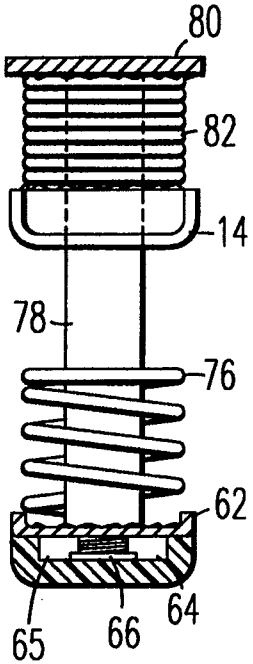
FIG. 7 is a horizontal cross-sectional view, partly in elevation, taken substantially along the line 7—7 of FIG. 3.

The second arm 51 of the bell crank 49 carries a headed pin 52 slideably received in a slot 54 in a link 56 pivotally connected at its outer end 58 to the inner end of a rod 60 slideably carried in a guide sleeve 62 fixed to and passing through the front frame member 14. The outer end of the rod 60 is rigidly fixed to the midpoint of the rear face of a stiff impact bar 62 whose front face is covered by a yieldable substance 64 such as sponge rubber as best seen in FIGS. 2 and 7.

The cover material 64 has recesses 65 therein for the reception of sensitive switches 66, preferably micro switches, which, when closed, connect an alarm 68 (FIG. 3) by way of electrical leads 70 to a power source. Thus, almost the instant the cover material 64 is struck, as by an over-height vehicle, sufficiently to compress the material one or all of the micro switches 66 within the cover material are closed and the alarm 68, which may be audible, visual or both, signals for the driver to stop his vehicle. Because there is inevitably a lapse of time between the onset of an alarm signal and the ability of a driver to react to the signal, a first lost motion distance is provided before the full force of an over-height vehicle can be exerted on the canopy assembly itself. In accordance with the invention this first lost motion distance, indicated by the arrows 72 in FIG. 3, is provided by the spacing between the inner ends 74 of springs 76 and the outer face of the outer frame member 14. The outer ends of the springs 76 are fixed, as by welding, to the rear face of the impact plate 62 and each spring coaxially surrounds a rod 78 whose outer end is also fixed, as by welding, to the inner face of the impact plate. Each rod 78 slideably passes with close clearance through an opening in the front frame member 14 and the inner end of each rod 78 is rigidly fixed to the front face of a plate 80 which also fixed, as by welding, to the inner end of a tension spring 82 whose outer end is welded to the rear face of the front frame member 14 and which, when unstressed as in FIG. 3, may be solid as shown, though this is not necessary as will be apparent to those skilled in the art.

Figure 6:
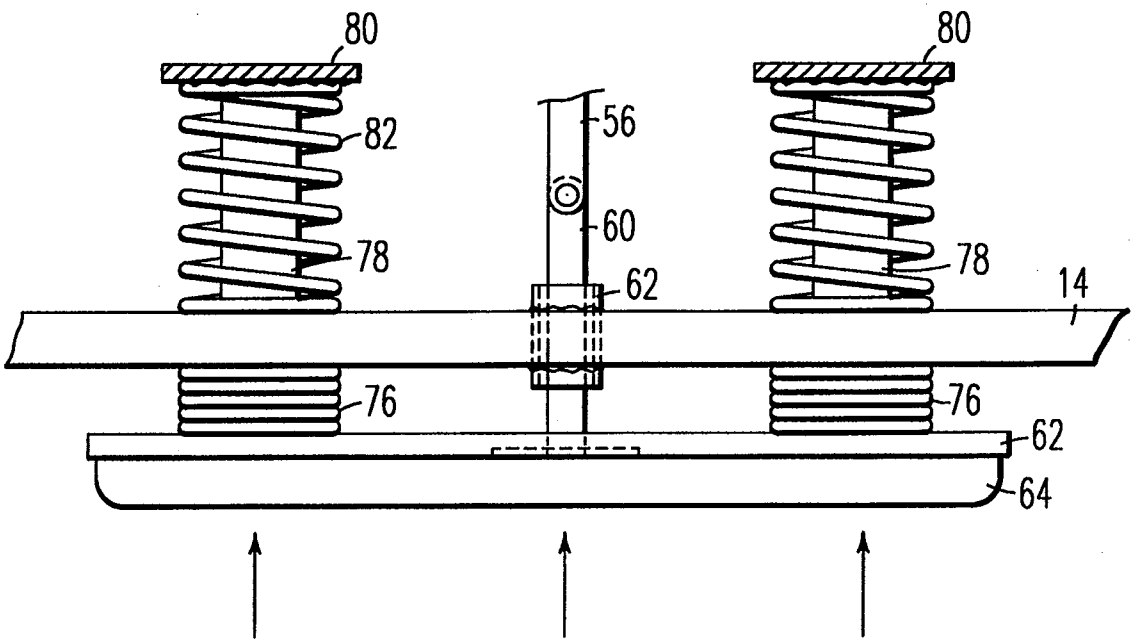
FIG. 6 is a change position view on a somewhat reduced scale of the impact bar when moved to its fully collapsed position in response to impact by an over-height vehicle.

From what has so far been described, it will be apparent that when an over-height vehicle first strikes cover material 64 it first energizes the alarm 68. Because the vehicle will be moving very slowly in anticipation of picking up a food order from a delivery area beneath the canopy, the lost motion provided by the distances 72 is sufficient to provide the driver enough time to stop the vehicle before the lost motion 72 is entirely take up, but even if it is, the first lost motion distance also includes the increment required to collapse the springs 76, after engaging the side member 14, to solid state as shown in FIG. 6. Should the driver still not react within this first lost motion period, then a second lost motion determined by the length of slot 54 is taken up resulting in retraction of the latch pin 32 as will now be described.

The slot 54 in the link 56 has a length which is selected so that as the springs 76 approach their solid condition of FIG. 6, the outer end 54' of the slot 54 engages the pin 52 to commence counter clockwise rotation of the bell crank 49. If the driver has still not stopped his vehicle at this point, just as the springs 76, or slightly before, go solid, the bell crank 49 is rotated sufficiently to retract pin 32 from the opening 36 in the support pole 22 and the entire canopy assembly is then free to be pivoted by the oncoming vehicle clear of its path of movement, thereby avoiding any damage to the canopy, or to the vehicle or to a roof-top load which it might be carrying. The vehicle will almost invariably stop at this point if, for no other reason but to pick up its order, at which time it will be made clear to the driver what the problem is and why the alarms were set off.

As soon as the impact plate is relieved of the pressure of the oncoming over-height vehicle, the inner springs 82, which had been stressed to their extended condition of FIG. 6, return to their original collapsed condition of FIG. 3, which they can do due to the fact that the connector 47 is flexible. Upon this occurrence the impact plate 62 is returned to its extended position of FIGS. 2 and 3 with the first lost motion distance 72 being fully restored.

After the over-height vehicle has completed its business and has been driven away, it is a simple matter for an attendant, by grasping a lanyard (not shown) carried at the end of the canopy assembly remote from its mounted end, to rotate the canopy in the opposite direction until the pin 32 snaps into the opening 36 in the pole.

Having now described the invention, it will be apparent that it is susceptible to a variety of changes and modifications without, however, departing from the scope and spirit of the appended claims.

What is claimed is:

1. In combination with a pivotal canopy assembly comprising a rigid frame having spaced apart front and rear members, opposed end members and a canopy carried by said frame; a mount pivotally supporting said frame from one end thereof to extend horizontally in cantilever fashion above ground level at a height selected to be greater than that of a majority of motor vehicles, a releasable latch for retaining said assembly in a predetermined radial position on said mount to extend over an area to be protected from weather and across which vehicles travel beneath said canopy in a direction from the front towards the rear side members of said frame, and means for releasing said latch in response to continued movement of an over-height vehicle against said canopy assembly to enable said assembly to be pivoted on said mount by said over-height vehicle from a position across its path of movement to a position clear of said path.

2. The combination of claim 1 including an impact bar movably connected to said front frame member, resilient means for biasing said impact bar to a position spaced from said front frame member, a normally open electric switch carried by said impact bar in a position to be closed upon initial impact of said bar by movement there against of an over-height vehicle, and an alarm responsive to closing of said switch to signal impact of said bar by an over-height vehicle.

3. The combination of claim 2 wherein said resilient means being collapsible over a first lost motion distance by continued movement of an over-height vehicle against said impact bar, and means responsive to movement of said impact bar relative to said frame and to collapse of said resilient means to a predetermined degree for effecting said release of said latch.

4. The combination of claim 3 wherein said mount for said canopy assembly comprises a pair of interfitting coaxial members, one being fixed and the other being carried by said frame for rotation on said fixed member, said releasable latch comprising a pair of lateral openings in the respective members which align when said canopy assembly is in its predetermined radial position, a pin slideably received in both said openings when aligned, and a mechanical connection between said impact bar and said pin to extract said pin from at least the opening in said fixed member to enable said canopy assembly to be pivoted by an oncoming over-height vehicle clear of its path of travel.

5. The combination of claim 4 wherein said mechanical connection comprises a bell crank mounted on said frame for pivoting about a vertical axis, a flexible connection between one arm of said bell crank and said pin, and a linkage including a second lost motion connection between said impact bar and a second arm of said bell crank wherein said bell crank is rotated to release said pin only after said impact bar has been caused to travel the distances of said first and second lost motion.

6. A canopy assembly comprising a rigid frame having spaced apart front and rear members, opposed end members and a canopy carried by said frame, a mount supporting said frame to extend horizontally above ground level at a height selected to be greater than that of a majority of motor vehicles, an impact bar movably connected to said front frame member, resilient means for biassing said impact bar a predetermined distance away from said front frame member, a normally open electric switch carried by said impact bar in a position to be closed upon initial impact of said bar by movements thereagainst of an over-height vehicle, and an alarm responsive to closing a said switch to signal impact of said bar by an over-height vehicle, said predetermined distance being a lost motion distance selected to enable said impact bar to travel towards said front frame member over a period of time sufficient to enable a normal driver to stop his vehicle in response to said alarm before said impact bar imparts the force of the oncoming over-height vehicle to said canopy assembly.

* * * * *